United States Patent [19]

Hofsäss

[11] Patent Number: 4,849,729

[45] Date of Patent: Jul. 18, 1989

[54] TEMPERATURE-SENSITIVE SWITCH WITH A CASING

[76] Inventor: Peter Hofsäss, Strietweg 45, D-7530 Pforzheim, Fed. Rep. of Germany

[21] Appl. No.: 176,206

[22] Filed: Mar. 31, 1988

[30] Foreign Application Priority Data

Mar. 31, 1987 [DE] Fed. Rep. of Germany ..... 3710672

[51] Int. Cl.[4] ..... H01H 61/02; H01H 71/16

[52] U.S. Cl. ..... 337/102; 337/107; 337/377

[58] Field of Search ..... 337/102, 103, 104, 105, 337/106, 107, 343, 377

[56] References Cited

U.S. PATENT DOCUMENTS 3,495,150 2/1970 Enemark ..... 337/107

4,528,540 7/1985 Stiekel et al. ..... 337/102

*Primary Examiner*—H. Broome

*Attorney, Agent, or Firm*—Antonelli, Terry & Wands

[57] ABSTRACT

A temperature-sensitive switch with a casing having a pot-like lower part and a top part, whereby in the lower part is provided a bimetallic disk and under the action of the latter at least one movable contact part can be connected to a stationary opposite contact, so that it is possible to produce an electrical connection between the lower part, movable contact part and opposite contact part. Between the contact part and the lower part there is a fixed, electrically high-value connection provided by a resistor element, so that the temperature-sensitive switch does not automatically close again after opening unless a master switch is interrupted for the power supply.

21 Claims, 3 Drawing Sheets

TEMPERATURE-SENSITIVE SWITCH WITH A CASING

BACKGROUND OF THE INVENTION

The invention relates to a temperature-sensitive switch with a casing having a pot-shaped lower part and a top part, whereby in the lower part is arranged a bimetallic disk and under the action of the latter at least one movable contact part can be brought into contact with a stationary opposite contact, so that an electrical connection can be formed between the lower part, movable contact part and opposite contact.

Numerous different constructions of such miniature temperature-sensitive switches have been proposed in, for example, DE-OS Nos. 17 90 103, 21 21 802, 24 33 901, 24 42 090, 24 42 397, 25 05 966, 25 11 314, 26 44 411, 29 17 482, 31 22 899. Reference should be made thereto for further details and the content thereof forms part of the present disclosure. They are very small compact switches with a casing and a pot-shaped lower part and an upper part closing the latter, with the casing containing a switch mechanism, which has one or more contacts centrally carried and switched by a bimetallic disk. A temperature-sensitive switch to which the present invention relates has dimensions of a few millimeters, e.g. a diameter of 5 to 8 mm and a height of less than 5 mm. If there is only one contact pair including a movable contact part and a stationary opposite contact part in the simplest form the current can flow over the bimetallic disk, but preferably takes place over an additional spring snap disk to the pot-shaped casing. In the case of two movable contacts with a corresponding opposite contact, they are carried by a common support part moved by the bimetallic disk and there is a direct current flow. From the opposite contacts, which are generally arranged on the fixed part, the current can be tapped by a current transmission element on one or more outer connecting contacts. Temperature switches, namely thermostats are known, which only interrupt the electrical contact and, for restoring the electrical connection, can either be switched back manually, or can be replaced. Temperature-sensitive switches are known, which switch back automatically after a significant temperature change and restore the electrical connection. It can occur that after cooling of the bimetallic disk, the latter switches back again and restores the electrical connection without removing the fault, which has led to the separation of the electrical connection through the bimetallic disk either directly due to increased current flow or indirectly due to increased temperature development. This gives so-called regulator cycles.

It is known in connection with open switches of another type to arrange high-value resistors between the connection ends and parallel to the switching contact and through same, after opening the switch, flows a small current which produces heat, so that the bimetallic disk is held at a higher temperature and consequently keeps the switch open. The current flow is only interrupted by an external interruption of the power supply, such as through switching off a master switch, so that only then can the bimetallic disk jump back again.

The aim underlying the present invention essentially resides in constructing the aforementioned miniature temperature-sensitive switches as self-holding temperature-sensitive switches. The small dimensions of the switches and the arrangement thereof in a closed, small casing are to be retained and a more effective heat production is to be obtained for reliably keeping the switch open.

According to the invention the above aim is attended in the case of a temperature-sensitive switch with a casing having a pot-shaped lower part and a top part, whereby in the lower part is arranged a bimetallic disk and under the action of the latter at least one movable contact part can be brought into connection with a stationary opposite contact, so that an electrical connection can be produced between the lower part, and movable contact part and the opposite contact, in that between the opposite contact part and the lower part there is a permanent higher-value electrical connection through a resistor part.

For the optimum solution, the present invention does not bridge by a high-value resistor the external connecting contacts which are connected to leads, as happens in known open switches in order to give them a self-holding construction. In the case of the inventive miniature switches, this would lead to a considerable increase in the size of the complete assembly, so that it would not be possible to use them for the intended purposes. It would also be disadvantageous in such a construction that the heat transfer from the high-value resistor to the bimetallic disk would be extremely poor. Therefore, the invention proposes an integrated solution with an integrated construction of the high-value resistor in the existing casing.

According to a preferred construction, the resistor part is a PTC element. The use of such PTC elements for bridging purposes is known per se. According to a particularly preferred construction, the electrical resistance of the resistor part is adjustable. Thus, a single high-value resistor part can be used for different switches which, in the case of the same construction, have bimetallic disks with different switching temperatures, which is adjusted in accordance with the bimetallic disk used and its switching temperature and is adapted thereto. According to a preferred construction the resistor part is a metallic or carbon resistor part guided in rounded manner and, in particular, the resistor part can be stamped from a metal disk or the carbon resistor is applied as a coating to a carrier, in particular by pressing on and is covered by a solidified glass melt. For setting purposes, according to a particularly preferred construction, between individual portions of the resistor part there are removable bridges.

Thus, according to a preferred construction, the invention proposes that the previous exclusively insulating cover part, which forms a mechanical connection between the stationary opposite contact or the current transfer element connected thereto from the stationary opposite contact to an external connecting contact part and the casing lower part, is constructed as a high-value resistor element or is provided with the same, so that there is a high-value connection between the stationary opposite contact and the metallic casing lower part.

The inventive switch can in particular be used at difficultly accessible points, where there is little space and/or contamination is likely. It can therefore be used within windings of electric motors, but also in the case of pressure can be inserted in front of lamps and in heating appliances. A particular advantage results from the combination of encapsulated miniature construction and self-holding, in that the switch can replace manually resettable switches. This is because it is possible to reduce the relatively large dimensions required for the resetting device and for the same security by the inventive switch.

Further advantages and features of the invention can be gathered from the claims and description of two embodiments of the inventive temperature-sensitive switch with reference to the accompanying drawings.

DETAILED DESCRIPTION

Figure 1:
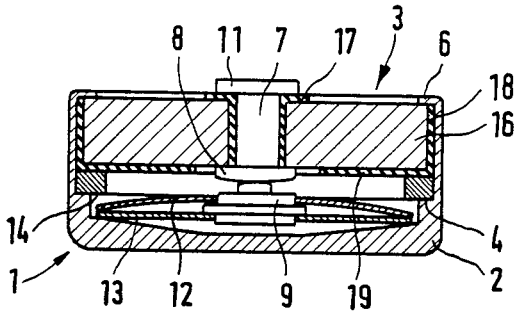
FIG. 1 is a cross-sectional view of an inventive temperature-sensitive switch.
Figure 2:
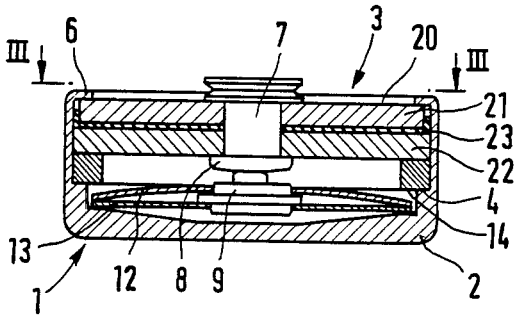
FIG. 2 is a cross-sectional view of another embodiment of the inventive temperature-sensitive switch.
Figure 3:
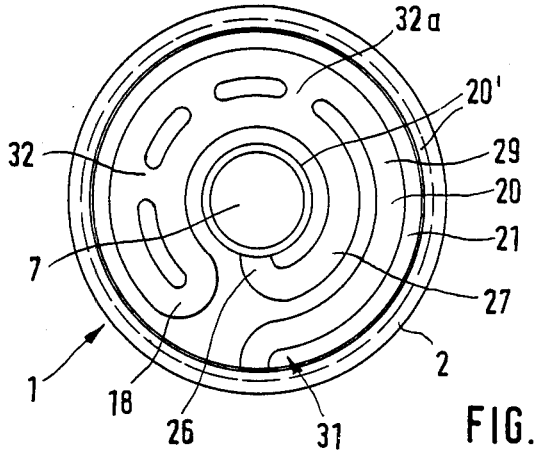
FIG. 3 is a top view taken in the direction of the arrows III—III in FIG. 2.

The inventive temperature-sensitive switches of FIGS. 1 and 2 are substantially circular, as can be gathered for the switch according to FIG. 2 from FIG. 3.

The temperature-sensitive switches of the present invention include a casing generally designated by the reference numeral 1 with a pot-shaped lower part generally designated by the reference numeral 2 and a cover part 3 closing the same. In per se known manner, the cover part 3 is directly or indirectly placed on an all-round shoulder 4 of the lower part two and is pressed against the same by a crimping or beading 6 of the lower part 2 provided on the opposite side of cover part 3. In known temperature-sensitive switches the cover part three is made from insulating material, such as a ceramic or plastic part or, to the extent that it is conductive, it is inserted in electrically insulating manner with respect to the pot-shaped lower part two. In the latter case, the electrically conductive portion of the cover part three serves as an opposite contact as in, for example, DE-OS 29 17 482. In the first-mentioned case the cover part 3 is traversed by one or more current transmission members 7, which towards the inside carry a stationary counter contact part 8 to a movable contact part 9 and towards the outside a connecting contact element 11 and are electrically interconnected.

In the illustrated embodiment, within the casing lower part 2 is located a bimetallic disk 12 and a spring snap disk 13 which, in central openings, surround and carry the movable contact part 9. In the represented position, disk 12 is relieved and contact part 9 is pressed by the spring snap disk 13 against the stationary opposite contact 8. On exceeding a predetermined temperature limit, the bimetallic disk 12 reversed and, consequently, its outer edge engages with shoulder 14 and presses contact 9, counter to the action of the spring snap disk 13, away from the opposite contact 8, so that the current flow which, in the represented closed position, passes from connecting contact 11 via connecting part 7, opposite contact 8, movable contact 9 and spring snap disk 13 to casing 2, to which can be connected the most external connection, is interrupted.

In the construction according to FIG. 1 cover part 3 has a so-called PTC element 16, which surrounds and carries the current transmission member 7 and is electrically connected to the latter and also at crimp 6 to the casing lower part 2. So that in the case of predetermined geometrical dimensions the current flow path across PTC element 16 and, consequently, the electrical resistance brought about by the latter is made as large as possible an insulating sleeve is arranged between the PTC element 16 and the current transmission member 7, so that PTC element 16 is only electrically connected in the inner lower region with the stationary opposite contact 8. In the same way, between the circumferential wall of PTC element 16 and the axially parallel wall of casing lower part 2 is provided insulating material 18, which is also drawn below PTC element 16 in area 19. As a result the contacting of PTC element 16 with casing lower part 2 only takes place in the vicinity of the upper outer circumference at crimp 6.

If the temperature-sensitive switch is closed (position shown), the current flows in the aforementioned manner across contact 9 and the spring snap disk 13, whereas, a current flow across PTC element 16 is negligible, because its resistance to the aforementioned current path is relatively large. If the switch now opens through raising contact 9 from opposite contact 8, a current determined by the resistance of PTC element 16 flows over the same and heats it. At a result of the heating a temperature is maintained at which the bimetallic snap disk 12 keeps the contact 9 away from opposite contact 8, so that this current path remains interrupted. A snapping back of disk 12 is only possible if the voltage applied via switch 1 is manually interrupted, so that no current can also flow across PTC element 16. As a result of the cooling, bimetallic disk 12 can again spring back into its represented relieved position, so that the connection between the contact and the opposite contact is restored under the action of the spring snap disk 13. After again applying a voltage, a current can again flow across opposite contact 8 into contact 9.

In the embodiment of FIG. 2 a resistor element 20 is arranged on a ceramic carrier 21 in such a way that it forms a high-value, conductive resistance connection between the current transmission member 7 and the wall of the casing lower part 2. In order to obtain a sought, large resistance of resistor element 20, the latter does not directly connect the current transmission member 7 radially to casing lower part 2 and instead has a curved or sinuous form with part ring-like interrupting areas, as shown in FIG. 3. Resistor element 20 has contact rings 20, and contacts with one of the same the current transmission member 7 at an attachment 26, then passes radially for a section and then initially in a part ring-like circle 27 to just before the attachment 26, at 28 passed somewhat further radially outwards and then in a second ring-like part 29 to a radial area 31 outside area generally designated by the reference numeral 26 and then radially again onto engaging the wall of lower part 2, where the outer contact ring 20 contacts the lower part 2 via its crimp 6. Below the ceramic carrier 21 is arranged a further ceramic part 22, between which is arranged an intermediate layer 23 of Teflon, Kapton, etc. for sealing purposes, whereby the layer can easily be bent upwards and secured between the wall of lower part 2 and insulating support 21 (FIG. 2, to the right). Branches 27, 29 are provided with radial connecting pieces 32. If all the radial connecting pieces 32 are retained, then the current flow can pass over the first radial connecting piece 32a and the resistance is low. It is also possible to start at radial connecting piece 32a with the breaking out of said connecting pieces, so that the resistance of resistor element 20 is increased and can therefore be stepwise adjusted to a desired value. Here again heat is produced in the resistor element 20, which keeps the bimetallic snap disk 12 in its high temperature position and therefore the switch in its open position.

In the case of the represented embodiment, initially two annular, metallic contacts 20 were fitted on the inner and outer boundaries of the annular ceramic support. Resistor element 20 is a carbon resistor applied to ceramic carrier 21 and was initially applied as a material containing carbon and a glass material with the described contour to the ceramic support surface. Heating melts the glass material and as a covering layer provides an insulating covering for the top of the carbon and fixes same in the applied contour. The connecting pieces 32a can be separated by sand jets or laser beams and, namely, as resistor element 20 is placed on the top of the ceramic support 21, also following the fitting of the switch, so that it is subsequently possible to make resistance changes or corrections, such as from a silver-palladium alloy.

Figure 4:
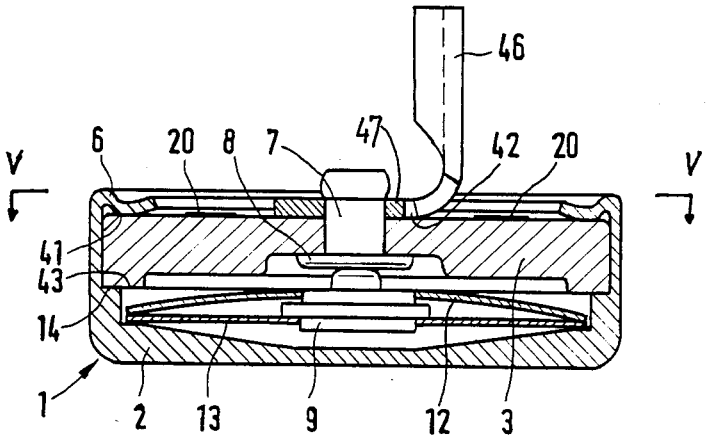
FIG. 4 is a cross-sectional view of yet another embodiment of the inventive temperature-sensitive switch in a section corresponding to that of FIG. 1.
Figure 5:
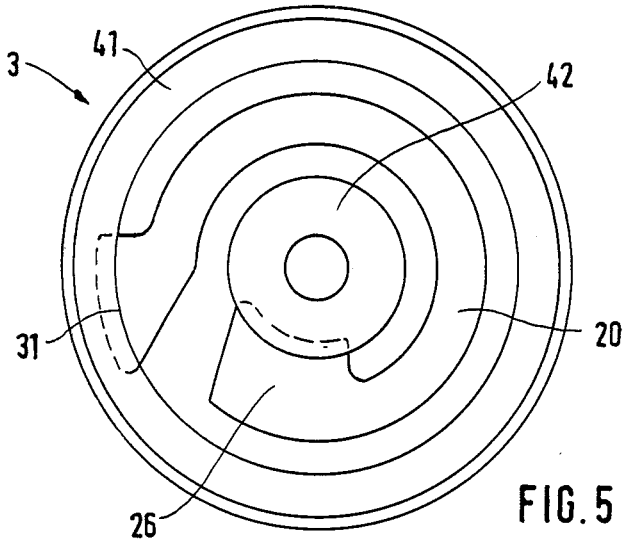
FIG. 5 is a plan view of the cover part of the construction of FIG. 4 taken in the direction of the arrows V—V.

In the construction according to FIGS. 4 and 5 in the pot-shaped lower part 2 of casing 1 is placed a one-piece cover part 3, which is made from oxide ceramic and forms the ceramic support for resistor element 20. The latter comprises a silver coating pressed onto cover part 3, which can be burnt in or stoved. The contact or connecting areas 26 are circumferentially widened in this embodiment, so that there is a good contact with contact rings 41, 42. Contact ring 41 is used for producing the electrical connection to the casing lower part 2, while contact ring 42 produces the electrical connection to the opposite contact 8 or current transmission member 7. These contacts can be assigned in that a tin coating is provided in areas 41, 42 and is initially pressed on and subsequently heated to above the flow point of tin. The tin thereby flows into the gaps between lower part 2 and cover part 3 and between the cover part 3 and the current transmission member 7 and, consequently, apart from good electric contact, forms a seal to the interior of casing 1, which aids other sealing measures, such as e.g. sealing rings (cf. also FIG. 6) between shoulder 14 of the lower part and the associated shoulder 43 of the upper part 3, which can also be provided and in part makes these unnecessary. Here again the upper edge of the lower part is bent over inwards in the form of a bead 6. By tinning the printed conductor at least in ring area 41, the bead 6 can be pressed into the relatively soft tin and can therefore also contribute to the sealing and electrical contacting in a simple manner. By soldering to the lower part 2 in the vicinity of bead 6 and/or current transmission member 7 (connecting or contact slot), a thermal seal can be obtained. For contacting on a stranded wire, the current transmission member 7 is provided with a connecting flap 46 projecting vertically from the casing surface via a foot part 47 thereof and in preferred manner permits the welding of the connecting slots 48 with the temperatures provided, without there being any need to fear overheating of the switch mechanism of the temperature-sensitive switch, because through the construction of connecting flap 46 the heat source for welding purposes is relatively distant from the switch mechanism. Only then is the connecting flap 46 bent round, so that there is a parallel extension over the cover part 3 to its foot part 47 engaging on the current transmission member 7 and in the opposite direction thereto (FIG. 7). The second connection is brought about by soldering a further stranded wire to lower part 2 (not shown). Cover part 3 is cast with the entire connecting area, formed by parts 7, 46, 47, 48, by a conventional casting or sealing material, which is transparent in the present embodiment, but can also be opaque. The actual resistor element 20 can also be covered by an insulating material, e.g. by applying a varnish, plastic or the like.

Figure 6:
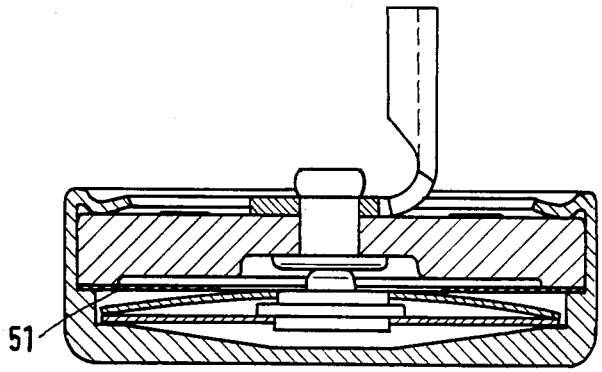
FIG. 6 is a cross-sectional view corresponding to that of FIG. 4 through an embodiment similar to that of FIG. 4 with an additional insulating disk.
Figure 7:
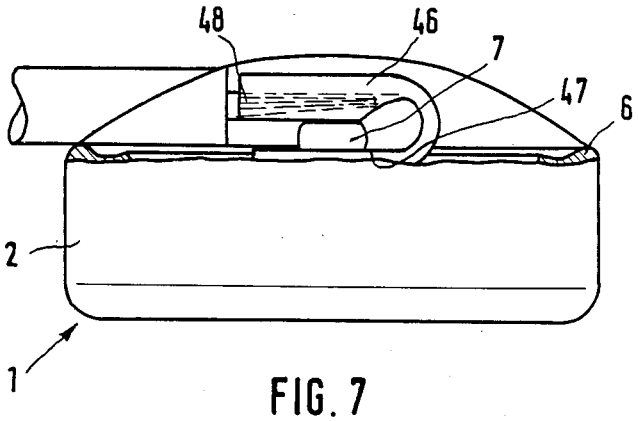
FIG. 7 is a side view of an inventive switch with cast cover part.

FIG. 6 shows a construction similar to FIG. 4, so that reference is made to the above comments concerning the same parts. A sealing disk 51 made from thermostable polyimide (Kapton) is again placed between lower part 2 and upper part 3 and secured between its shoulder 14 and switch 43, so that a mechanical seal is obtained. As a result of this construction, in certain cases there is no need for sealing by tin and possibly soldering, although this can be provided.

The essential advantage of the inventive switch is that, despite construction as a self-holding switch, in the case of a high sealing action it can still have extremely small dimensions, in the same way as conventional miniature bimetallic switches, so that the "self-holding" characteristic is achieved without any additional volume being required. The inventive switch can use conventional lower parts, switch mechanisms and contact-/connecting parts, so that only few new parts need be inserted. This may optionally solely consist of an inventive top part in place of a conventional one, the high-value resistance necessary for bridging the switch mechanism is obtained in the inventive manner. The inventive switch can replace conventional switches where they have previously been used and no additional space is needed. The represented switches e.g. have diameters of 8 to 9 mm and heights of 2 to 2.5 mm (without casting or sealing material and connecting flap, but with the latter 3.5 to 4 mm), accompanied by a cover part thickness, including the resistor element 20, of up to 1 mm, in the case of adequate insulation.

I claim:

1. Temperature-sensitive switch comprising a casing, a pot-shaped lower part and an upper part, the lower part containing a switch mechanism with at least one bimetallic disk and a movable contact part and, under the action of the bimetallic disk, the movable contact part can be connected to a stationary opposite contact, so that it is possible to produce an electrical connection between the pot-shaped lower part, movable and stationary opposite contact parts, wherein a resistor part having a high electrical resistance is arranged between the opposite stationary contact part and the pot-shaped lower part so as to form a permanent electric connection therebetween, said resistor part being arranged within a contour of the casing.

2. Temperature-sensitive switch according to claim 1, wherein the resistor part includes a PTC element.

3. Temperature-sensitive switch according to claim 1, wherein the electrical resistance of the resistor part is adjustable.

4. Temperature-sensitive switch according to one of claims 1 or 3, wherein the resistor part includes a metal resistor part guided in spiral bends.

5. Temperature-sensitive switch according to claim 4, wherein the resistor part includes a stamped metal disk.

6. Temperature-sensitive switch according to one of claims 1 or 3, wherein the resistor part includes a carbon resistor part.

7. Temperature-sensitive switch according to claim 6, wherein a insulating cover is one of melted or cast around the resistor part.

8. Temperature-sensitive switch according to claim 4, wherein removable bridges are formed between individual portions of the resistor part.

9. Temperature-sensitive switch according to claim 6, wherein removable bridges are formed between individual portions of the resistor part.

10. Temperature-sensitive switch according to claim 1, wherein support means are disposed in said casing for supporting the resistor part therein, said support means being made from insulating material.

11. Temperature-sensitive switch according to claim 10, wherein the support means is made form a ceramic material.

12. Temperature-sensitive switch according to one of claims 10 or 11, wherein the resistor part is pressed onto the support means.

13. Temperature-sensitive switch according to claim 1, wherein sealing means are provided for sealing the switch mechanism in the casing so as to protect the switch mechanism from the environment, said sealing means including a sealing disk.

14. Temperature-sensitive switch according to claim 1, wherein a seal means is provided for sealing the switch mechanism in the casing so as to protect the switch mechanism from the environment and outside effects, said seal means including a soldering.

15. Temperature-sensitive switch according to claim 1, wherein said reistor part surrounds a portion of the stationary contact part.

16. Temperature-sensitive switch according to claim 15, wherein the stationary contact part includes a current transmission member; and wherein said resistor part surrounds the current transmission member.

17. Temperature-sensitive switch according to claim 16, wherein the pot-shaped lower part includes a crimp portion at an upper end thereof, and wherein said resistor part is electrically connected to said pot-shaped lower part through said crimp portion.

18. Temperature-sensitive switch according to claim 17, wherein said resistor part includes a PTC element.

19. Temperature-sensitive switch according to claim 18, wherein an insulating material is provided around said PTC element in such a fashion that a contact between the PTC element and the pot-shaped lower part only occurs at the crimp portion.

20. Temperature-sensitive switch according to claim 1, wherein the stationary contact part includes a current transmission member having a contact at one end thereof cooperable with the movable contact part, and wherein a ceramic part is interposed between the resistor part and the contact provided at the end of the current transmission member.

21. Temperature-sensitive switch according to claim 1, wherein the resistor part and the ceramic part surround the current transmission member, and wherein an intermediate layer is interposed between the resistor part and the ceramic part.

* * * * *